US012410555B2

(12) United States Patent
Sakai et al.

(10) Patent No.: US 12,410,555 B2
(45) Date of Patent: Sep. 9, 2025

(54) METAL-COVERED LIQUID CRYSTAL POLYESTER MULTIFILAMENT

(71) Applicant: KURARAY CO., LTD., Kurashiki (JP)

(72) Inventors: Tomoki Sakai, Okayama (JP); Takashi Katayama, Tokyo (JP); Hiroyuki Kawai, Okayama (JP); Masashi Nishida, Tokyo (JP); Tsugumi Yoshida, Kurashiki (JP)

(73) Assignee: KURARAY CO., LTD., Kurashiki (JP)

( * ) Notice: Subject to any disclaimer, the term of this patent is extended or adjusted under 35 U.S.C. 154(b) by 729 days.

(21) Appl. No.: 17/758,639

(22) PCT Filed: Dec. 23, 2020

(86) PCT No.: PCT/JP2020/048244
§ 371 (c)(1),
(2) Date: Jul. 12, 2022

(87) PCT Pub. No.: WO2021/145180
PCT Pub. Date: Jul. 22, 2021

(65) Prior Publication Data

US 2023/0096613 A1 Mar. 30, 2023

(30) Foreign Application Priority Data

Jan. 15, 2020 (JP) ..... 2020-004487

(51) Int. Cl.
*D06M 11/00* (2006.01)
*D02G 3/04* (2006.01)
*D06M 11/83* (2006.01)

(52) U.S. Cl.
CPC ..... *D06M 11/83* (2013.01); *D02G 3/045* (2013.01); *D10B 2331/04* (2013.01); *D10B 2401/063* (2013.01); *D10B 2401/16* (2013.01)

(58) Field of Classification Search
CPC ..... D06M 11/83; D06M 10/06; H01B 7/1825; D02G 3/045; D02G 3/40; D02G 3/441;
(Continued)

(56) References Cited

U.S. PATENT DOCUMENTS

2012/0021218 A1 1/2012 Lee et al.
2016/0289857 A1 10/2016 Kondo et al.
(Continued)

FOREIGN PATENT DOCUMENTS

CN 104024495 A * 9/2014 ..... D06M 15/643
JP 47-43160 B1 10/1972
(Continued)

OTHER PUBLICATIONS

English translation of the International Preliminary Report on Patentability and Written Opinion issued Jul. 28, 2022 in PCT/JP2020/048244, 7 pages.
(Continued)

*Primary Examiner* — Eisa B Elhilo
(74) *Attorney, Agent, or Firm* — Element IP, PLC

(57) ABSTRACT

A metal-covered liquid crystal polyester multifilament, comprising: two or more metal-covered liquid crystal polyester monofilaments in which a surface of each liquid crystal polyester monofilament is covered with a metal having a thickness of 0.1 to 20 μm, wherein in a cross-sectional photograph measured by X-ray CT, a percentage of a number of stuck fibers in which the two or more metal-covered liquid crystal polyester monofilaments are stuck is 75% or less with respect to a total number of fibers.

16 Claims, 8 Drawing Sheets

(58) Field of Classification Search
CPC ..... D10B 2331/04; D10B 2401/063; D10B 2401/16; D10B 2331/042
USPC ..... 8/115.6
See application file for complete search history.

(56) References Cited

U.S. PATENT DOCUMENTS

2018/0187077 A1 7/2018 Lee et al.
2018/0209060 A1 7/2018 Kondo et al.

FOREIGN PATENT DOCUMENTS

JP 2008214842 A * 9/2008 ..... D01F 6/62
JP 2010189819 A * 9/2010 ..... D02J 1/22
JP 2010209495 A * 9/2010 ..... D02J 13/00
JP 2011231382 A 11/2011
JP 2013133575 A * 7/2013 ..... D01F 6/62
JP 2013136860 A * 7/2013 ..... D01F 6/62
JP 2013533387 A 8/2013
JP 2013204125 A 10/2013
JP 2014055388 A 3/2014
JP 2016169464 A * 9/2016 ..... D01F 6/62
JP 2016195091 A 11/2016
JP 2016212960 A * 12/2016 ..... D07B 1/02
JP 2017179647 A * 10/2017 ..... D01F 8/84
JP 2018009259 A 1/2018
WO WO-2012012614 A2 1/2012
WO WO 2012132851 A1 * 10/2012 ..... D01F 6/625

OTHER PUBLICATIONS

International Search Report issued Mar. 23, 2021 in PCT/JP2020/048244, 3 pages.
Extended European Search Report issued Mar. 1, 2024 in corresponding European Patent Application No. 20913117.6, 7 pages.

* cited by examiner

METAL-COVERED LIQUID CRYSTAL POLYESTER MULTIFILAMENT

TECHNICAL FIELD

The present invention relates to a metal-covered liquid crystal polyester multifilament that can be used as a conductive member in the smart textile field, electromagnetic wave shielding applications and the like.

BACKGROUND ART

In recent years, smart textiles in which clothing and equipment are combined have been actively developed (for example, Patent Document 1). For example, as a smart textile, a garment that measures information such as a heart rate in real time on wearing of a garment to which a conductive fiber is applied, and a knit heater in which an electric circuit is directly woven on a garment and which is heated by an external electrode are known. Conductive fibers used in such smart textiles are required to have bending fatigue resistance, wearability and the like in addition to conductivity and strength.

Meanwhile, as conductive fibers having high conductivity and strength, plated fibers in which high-strength fibers such as polyallylate fibers are covered with metal have been studied (for example, Patent Document 2). Such a polyallylate fiber is usually used in a state where the spinning raw yarn has been solid phase polymerized by heat treatment to impart strength and elastic modulus.

PRIOR ART DOCUMENTS

Patent Documents

Patent Document 1: JP-A-2018-9259
Patent Document 2: JP-A-2016-195091

SUMMARY OF THE INVENTION

Problems to be Solved by the Invention

However, the study of the present inventors found that the metal-covered fiber plated with the polyallylate fiber as described in Cited Document 2 has an insufficient bending fatigue resistance, the resistance may greatly increase when it is repeatedly bent, and the wearability when it is used for a smart textile material is insufficient due to the low flexibility (or softness).

Thus, an object of the present invention is to provide a metal-covered liquid crystal polyester multifilament having excellent wearability of clothing and bending fatigue resistance even when it is used as a smart textile material.

Solutions to the Problems

As a result of intensive studies to solve the above problems, the present inventors have found that the above problems can be solved by a metal-covered liquid crystal polyester multifilament, comprising: two or more metal-covered liquid crystal polyester monofilaments in which a surface of each liquid crystal polyester monofilament is covered with a metal having a thickness of 0.1 to 20 μm, wherein a percentage of a number of stuck fibers is 75% or less with respect to a total number of fibers, thereby completing the present invention. That is, the present invention includes the following aspects.

[1] A metal-covered liquid crystal polyester multifilament, comprising: two or more metal-covered liquid crystal polyester monofilaments in which a surface of each liquid crystal polyester monofilament is covered with a metal having a thickness of 0.1 to 20 μm, wherein in a cross-sectional photograph measured by X-ray CT, a percentage of a number of stuck fibers in which the two or more metal-covered liquid crystal polyester monofilaments are stuck is 75% or less with respect to a total number of fibers.

[2] The metal-covered liquid crystal polyester multifilament according to [1], wherein in a cross-sectional photograph measured by X-ray CT, a distance between any two farthest points on a surface of a metal covering the stuck fibers is 11 times or less a diameter of the two or more metal-covered liquid crystal polyester monofilaments.

[3] The metal-covered liquid crystal polyester multifilament according to [1] or [2], having a tensile strength of 16 cN/dtex or more.

[4] The metal-covered liquid crystal polyester multifilament according to any one of [1] to [3], wherein the metal includes at least one selected from the group consisting of copper, silver, gold, iron, zinc, lead, palladium, nickel, chromium, tin, titanium, aluminum, indium, and vanadium.

[5] The metal-covered liquid crystal polyester multifilament according to any one of [1] to [4], wherein a fineness of each of the liquid crystal polyester monofilament is 11 dtex or more.

[6] The metal-covered liquid crystal polyester multifilament according to any one of [1] to [5], wherein a specific resistance value that is a ratio of a resistance value after a bending fatigue test to a resistance value before a bending fatigue test is 25 or less.

Effects of the Invention

The metal-covered liquid crystal polyester multifilament of the present invention is excellent in wearability of clothing and bending fatigue resistance even when it is used as a smart textile material.

EMBODIMENTS OF THE INVENTION

Figure 1:
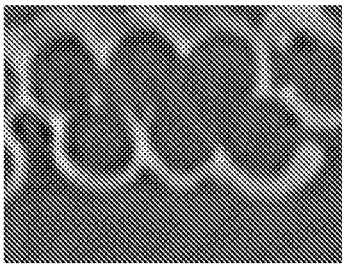
FIG. 1 shows an X-ray CT cross-sectional photograph showing a state in which a metal (white part) is not interposed between monofilaments due to sticking of fibers.

The metal-covered liquid crystal polyester multifilament of the present invention comprises two or more metal-covered liquid crystal polyester monofilaments in which a surface of each liquid crystal polyester monofilament is covered with a metal having a thickness of 0.1 to 20 μm, wherein in a cross-sectional photograph measured by X-ray CT, a percentage of a number of stuck fibers in which the two or more metal-covered liquid crystal polyester monofilaments are stuck (sometimes referred to as sticking percentage) is 75% or less with respect to a total number of fibers.

The present inventors have succeeded in reducing stuck parts, that is, reducing a percentage of a number of stuck fibers to 75% or less with respect to the total number of fibers in view of the fact that a conventional liquid crystal polyester multifilament is likely to have a stuck part due to heat treatment during solid phase polymerization, and the formation of a metal cover is difficult in such a part, and surprisingly found that even the flexibility (or softness) as well as the bending fatigue resistance of a resulting metal-covered fiber are remarkably improved and the metal-covered fiber is excellent in wearability of clothing even when used as a smart textile material.

In the present specification, "filament" may be referred to as "fiber", "monofilament" may be referred to as "single fiber", "cover" may be referred to as "plating", "liquid crystal polyester multifilament" may be simply referred to as "multifilament", "liquid crystal polyester monofilament" may be simply referred to as "monofilament", and "liquid crystal polyester multifilament" and "liquid crystal polyester monofilament" may be collectively referred to as "liquid crystal polyester fiber".

<Liquid Crystal Polyester Monofilament>

A high-strength liquid crystal polyester fiber can be produced, for example, by melt-spinning a liquid crystal polyester and further solid-phase polymerizing a spinning raw yarn. A liquid crystal polyester multifilament is a fiber in which two or more liquid crystal polyester monofilaments are collected.

A liquid crystal polyester is a polyester that exhibits optical anisotropy (liquid crystallinity) in a molten phase, and can be identified by, for example, placing a sample on a hot stage, heating the sample under a nitrogen atmosphere, and observing transmitted light of the sample with a polarizing microscope. The liquid crystal polyester is composed of, for example, a repeating constitutional unit derived from an aromatic diol, an aromatic dicarboxylic acid, or an aromatic hydroxycarboxylic acid, and the chemical constitution of the constitutional unit is not particularly limited as long as the effect of the present invention is not impaired. Furthermore, the liquid crystal polyester may contain a constitutional unit derived from an aromatic diamine, an aromatic hydroxyamine, or an aromatic aminocarboxylic acid as long as the effect of the present invention is not inhibited.

Examples of preferred constitutional units include those shown in Table 1.

TABLE 1

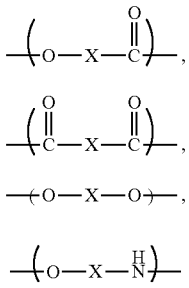

(X in the formula is selected from the following structures.)

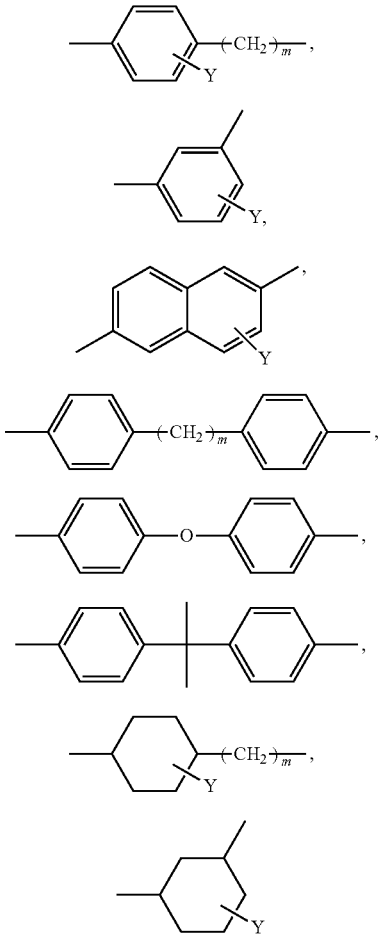

(m = 0 to 2, Y = a substituent selected from hydrogen, a halogen atom, an alkyl group, an aryl group, an aralkyl group, an alkoxy group, an aryloxy group, and an aralkyloxy group.

Y is present in a number in a range from 1 to the maximum number that can be substituted in the aromatic ring, and is each independently selected from the group consisting of a hydrogen atom, a halogen atom (for example, a fluorine atom, a chlorine atom, a bromine atom, and an iodine atom), an alkyl group (for example, an alkyl group having 1 to 4 carbon atoms such as a methyl group, an ethyl group, an isopropyl group, and a t-butyl group), an alkoxy group (for example, a methoxy group, an ethoxy group, an isopropoxy group, and an n-butoxy group), an aryl group (for example, a phenyl group and a naphthyl group), an aralkyl group [for example, a benzyl group (a phenylmethyl group), a phenethyl group (a phenylethyl group)], an aryloxy group (for example, a phenoxy group), and an aralkyloxy group (for example, a benzyloxy group).

Examples of more preferred constitutional units include the constitutional units shown in examples (1) to (18) shown in Tables 2, 3, and 4 below. When the constitutional unit in the formula is a constitutional unit that may indicate multiple structures, two or more of such constitutional units may be combined and used as the constitutional unit that constitutes the polymer.

TABLE 2

(1)

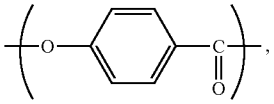

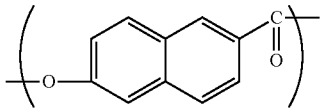

(2)

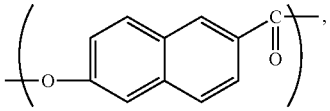

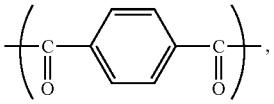

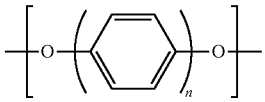

(3)

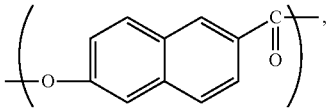

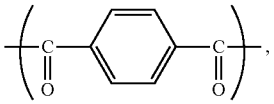

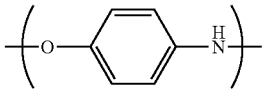

(4)

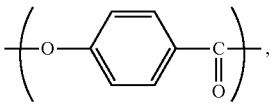

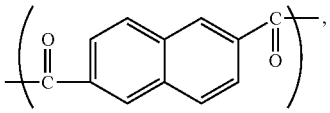

TABLE 2-continued

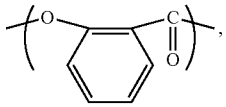

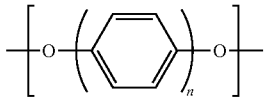

(5)

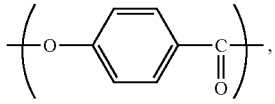

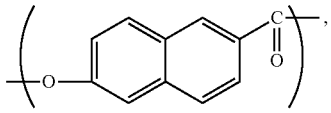

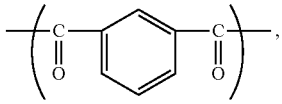

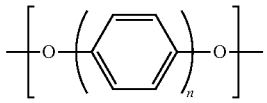

(6)

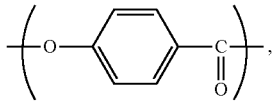

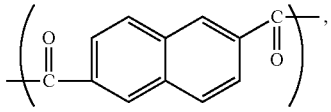

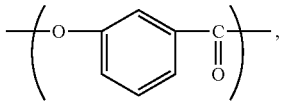

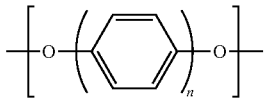

(7)

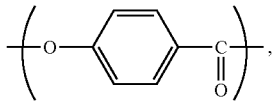

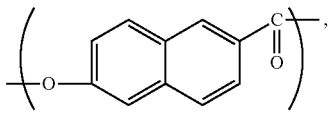

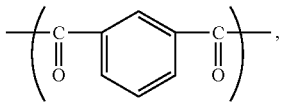

TABLE 2-continued
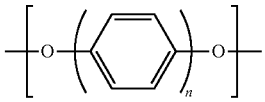
(8)
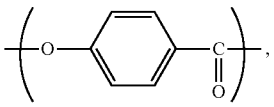
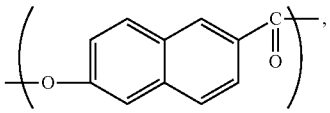
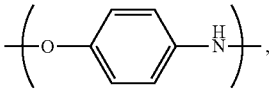
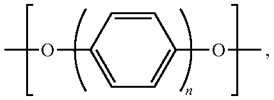
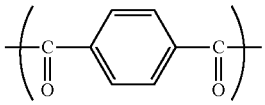
TABLE 3
(9)
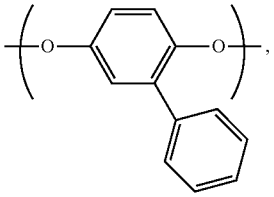
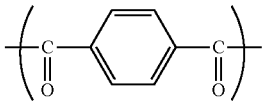
(10)
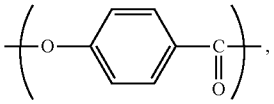
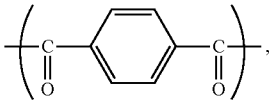
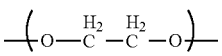
(11)
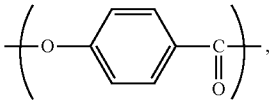
TABLE 3-continued
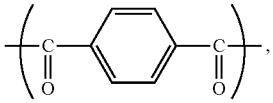
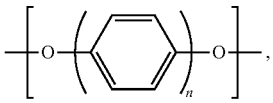
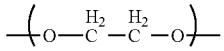
(12)
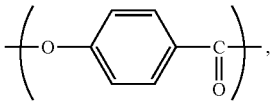
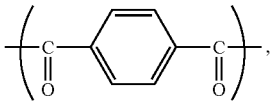
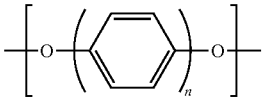
(13)
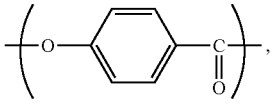
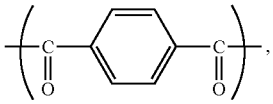
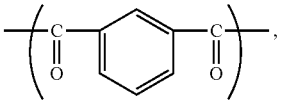
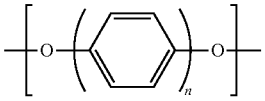
(14)
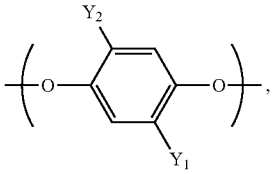
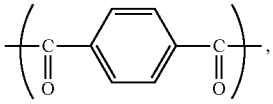
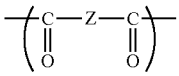
(15)
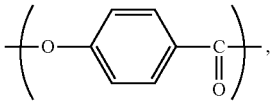

TABLE 3-continued

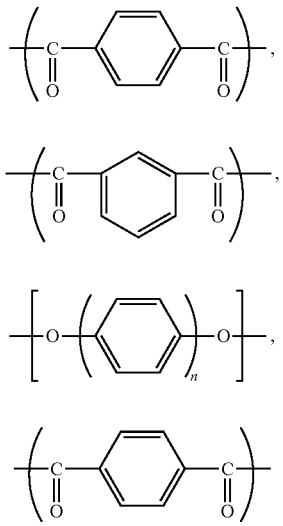

TABLE 4

(16)

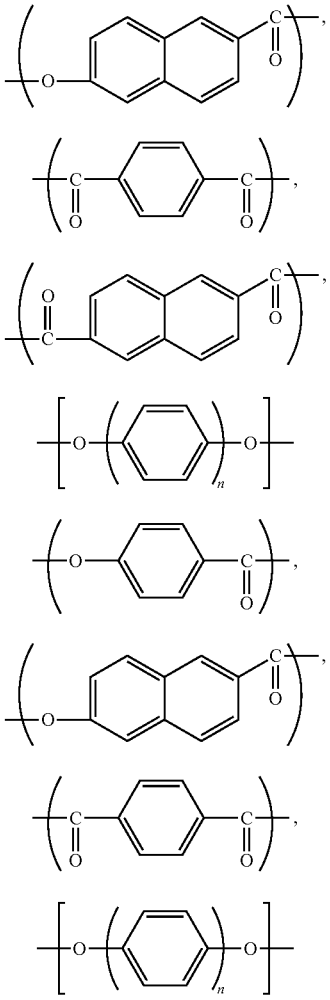

(17)

TABLE 4-continued (18)

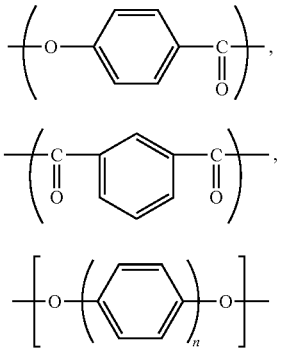

In the constitutional units of Tables 2, 3, and 4, n is an integer of 1 or 2, each of the constitutional units n=1 and n=2 may be present alone or in combination, and $Y_1$ and $Y_2$ may be each independently a hydrogen atom, a halogen atom (for example, a fluorine atom, a chlorine atom, a bromine atom, and an iodine atom), an alkyl group (for example, an alkyl group having 1 to 4 carbon atoms such as a methyl group, an ethyl group, an isopropyl group, and a t-butyl group), an alkoxy group (for example, a methoxy group, an ethoxy group, an isopropoxy group, and an n-butoxy group), an aryl group (for example, a phenyl group and a naphthyl group), an aralkyl group [for example, a benzyl group (a phenylmethyl group), a phenethyl group (a phenylethyl group)], an aryloxy group (for example, a phenoxy group), an aralkyloxy group (for example, a benzyloxy group) and the like. Among these, preferred examples of Y include a hydrogen atom, a chlorine atom, a bromine atom, and a methyl group.

Examples of Z include a substituent represented by the following formula.

[Chemical Formula 1]

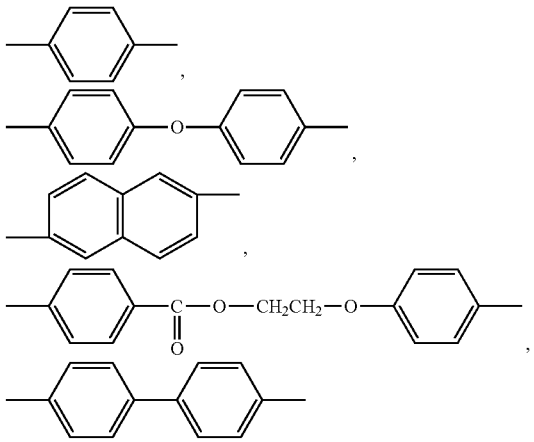

A preferred liquid crystal polyester preferably has two or more naphthalene skeletons as constitutional units. Particularly preferably, the liquid crystal polyester includes both a constitutional unit (A) derived from hydroxybenzoic acid and a constitutional unit (B) derived from hydroxynaphthoic acid. Examples of the constitutional unit (A) include one represented by the following formula (A), examples of the constitutional unit (B) include one represented by the following formula (B), and the ratio of the constitutional unit (A) to the constitutional unit (B) may be preferably in the range of 9/1 to 1/1, more preferably in the range of 7/1 to 1/1, and still more preferably in the range of 5/1 to 1/1 from the viewpoint of tending to improve melt formability.

[Chemical Formula 2]

(A)

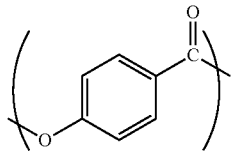

[Chemical Formula 3]

(B)

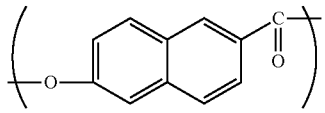

The total of the constitutional unit (A) and the constitutional unit (B) may be, for example, 65 mol % or more, more preferably 70 mol % or more, and still more preferably 80 mol % or more with respect to all the constitutional units. In particular, a liquid crystal polyester having 4 to 45 mol % of the constitutional unit (B) in the polymer is preferred.

The melting point of the liquid crystal polyester suitably used in the present invention is preferably 250 to 360° C., and more preferably 260 to 320° C. The melting point refers to a main absorption peak temperature measured and observed by a differential scanning calorimeter (DSC; "TA 3000" manufactured by METTLER TOLEDO) in accordance with JIS K 7121 test method. Specifically, an endothermic peak when 10 to 20 mg of a sample is sealed in an aluminum pan in the DSC instrument, then nitrogen as a carrier gas is circulated at 100 cc/min, and the temperature is raised at 20° C./min is measured. When a clear peak does not appear in the 1st run in DSC measurement depending on the kind of the polymer, the endothermic peak may be measured as follows: the temperature is raised to a temperature 50° C. higher than the expected flow temperature at a temperature rising rate of 50° C./min, the temperature is held for 3 minutes to completely melt the sample, then the sample is cooled to 50° C. at a temperature falling rate of −80° C./min, and then the endothermic peak is measured at a temperature rising rate of 20° C./min.

To the liquid crystal polyester, thermoplastic polymers such as polyethylene terephthalate, modified polyethylene terephthalates, polyolefins, polycarbonates, polyamides, polyphenylene sulfide, polyether ether ketone, and fluororesins may be added as long as the effect of the present invention is not impaired. Various additives such as inorganic substances such as titanium oxide, kaolin, silica, and barium oxide, colorants such as carbon black, dyes, and pigments, antioxidants, ultraviolet absorbers, and light stabilizers may be also added.

In the liquid crystal polyester fiber obtained by melt-spinning of the liquid crystal polyester, the fineness of the liquid crystal polyester monofilament is preferably 1.5 dtex or more, more preferably 2.5 dtex or more, and still more preferably 5.0 dtex or more. In a preferred embodiment of the present invention, the fineness of the liquid crystal polyester monofilament is preferably 11 dtex or more, more preferably 15 dtex or more, still more preferably 20 dtex or more, and particularly preferably 25 dtex or more. When the fineness of the liquid crystal polyester monofilament is equal to or more than the above lower limit, sticking of single fibers due to solid phase polymerization tends to be suppressed, so that the wearability and the bending fatigue resistance tend to be improved. The upper limit of the fineness of the liquid crystal polyester monofilament is preferably 100 dtex or less, and more preferably 50 dtex or less. When the fineness of the liquid crystal polyester monofilament is equal to or less than the above upper limit, the solidification efficiency immediately after melt-spinning and the solid phase polymerization rate are likely to increase.

<Metal>

In the metal-covered liquid crystal polyester multifilament of the present invention, a surface of each liquid crystal polyester monofilament is covered with a metal having a thickness of 0.1 to 20 μm. In the present specification, the metal includes not only metals described later but also conductive metal oxides or metal nitrides including metals described later.

Though the metal is not particularly limited, the metal preferably contains, for example, at least one selected from the group consisting of copper, silver, gold, iron, zinc, lead, palladium, nickel, chromium, tin, titanium, aluminum, indium, and vanadium, and more preferably contains at least one selected from the group consisting of copper, nickel, silver, gold, and iron. When these metals are contained, the conductivity and bending fatigue resistance of the metal-covered liquid crystal polyester multifilament tend to be improved. These metals can be used singly or in combination of two or more thereof.

The thickness of the metal covering the surface of the liquid crystal polyester monofilament is 0.1 to 20 μm, preferably 0.2 μm or more, more preferably 0.5 μm or more, and still more preferably 15 μm or less, more preferably 10 μm or less. When the thickness of the metal is equal to or more than the above lower limit, the conductivity increases and the initial resistance value tends to be reduced, and when the thickness of the metal is equal to or less than the above upper limit, the wearability and the bending fatigue resistance tend to be improved. The thickness of the metal can be measured by X-ray CT, and for example, can be measured by the method described in Examples.

<Metal-Covered Liquid Crystal Polyester Multifilament>

The metal-covered liquid crystal polyester multifilament of the present invention comprises two or more metal-covered liquid crystal polyester monofilaments in which a surface of each liquid crystal polyester monofilament is covered with the metal.

In the metal-covered liquid crystal polyester multifilament of the present invention, in a cross-sectional photograph measured by X-ray CT, a percentage (sticking percentage) of a number of stuck fibers in which the two or more metal-covered liquid crystal polyester monofilaments are stuck is 75% or less with respect to a total number of fibers. Thus the metal-covered liquid crystal polyester multifilament of the present invention has high flexibility (or softness) and is excellent in wearability of clothing even when used as a smart textile material. Further, since the stuck part is reduced, the bending fatigue resistance is also excellent, and the change in the resistance value can be effectively suppressed even when the metal-covered liquid crystal polyester multifilament is repeatedly bent. As described above, the metal-covered liquid crystal polyester multifilament of the present invention is useful as a smart textile material (for example, an electrode, wiring or the like of a smart textile) because it can achieve both excellent wearability and bending fatigue resistance. Since the metal-covered liquid crystal polyester multifilament has excellent bending fatigue resistance, it can be also suitably used for electric wires, electromagnetic wave shielding materials and the like.

The percentage (sticking percentage) of a number of stuck fibers is preferably 70% or less, more preferably 65% or less, even more preferably 50% or less, still more preferably 40% or less, particularly preferably 30% or less, more particularly preferably 20% or less, and most preferably 15% or less with respect to a total number of fibers. When the sticking percentage is equal to or less than the above upper limit, the flexibility and the wearability tend to be more improved, and the bending fatigue resistance tends to be more increased. The lower limit of the sticking percentage is usually 0% or more.

The sticking percentage can be determined by taking 10 cross-sectional photographs of a metal-covered liquid crystal polyester multifilament at intervals of 50 μm (intervals in a direction perpendicular to the cross section) by X-ray CT, counting the number of stuck fibers that are stuck and the number of all fibers in the cross-sectional photographs in the 10 cross-sectional photographs, and performing calculation based on the following formula.

$$\text{Sticking percentage (\%)} = (\text{Number of stuck fibers})/(\text{Number of all fibers}) \times 100$$

For the X-ray CT cross-sectional photograph in the present invention, a cross-sectional photograph in which 90% or more of filaments are present is used when the number of filaments of the metal-covered liquid crystal polyester multifilament is 100 or less, and a cross-sectional photograph in which at least 100 filaments are present is used when the number of filaments is more than 100.

The fibers that are stuck and the fibers that are not stuck can be discriminated by the following method. For example, FIG. 5 is an X-ray CT cross-sectional photograph of a metal-covered liquid crystal polyester multifilament obtained in Example 4. In the X-ray CT photograph (image), the plated metal covering fibers is observed in white. Thus, fibers in which monofilaments are stuck and fibers in which monofilaments are not stuck can be discriminated based on the form of the metal part (white part). Specifically, states of fibers that are not stuck are shown in FIGS. 3 and 4, and states of fibers that are stuck are shown in FIGS. 1 and 2.

Figure 3:
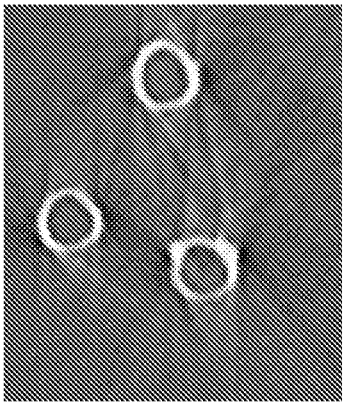
FIG. 3 shows an X-ray CT cross-sectional photograph showing a state in which the entire monofilaments are covered with a metal.

The X-ray CT cross-sectional photograph of FIG. 3 shows a state in which the entire circumference (the entire surface) of the monofilament is covered with a metal, and the monofilament can be determined to be a fiber that is not stuck.

Figure 4:
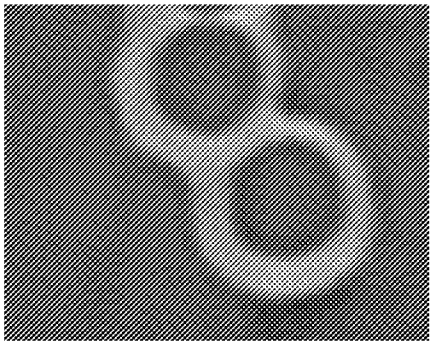
FIG. 4 shows an X-ray CT cross-sectional photograph showing metal-covered fibers in which the entire monofilaments are covered with a metal and a state in which the metal on one monofilament and the metal on the other monofilament are in close contact with each other.
Figure 5:
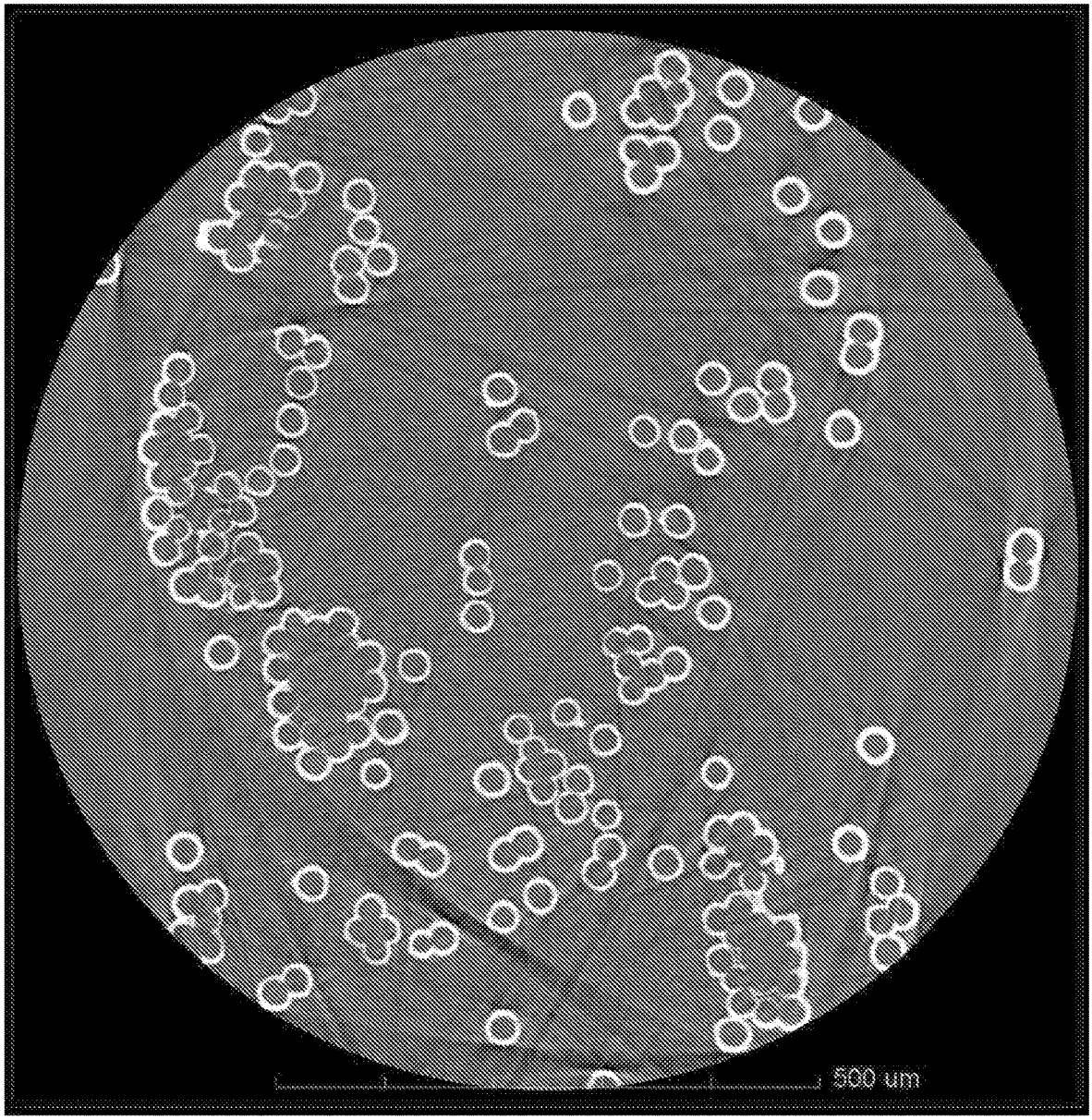
FIG. 5 shows an X-ray CT cross-sectional photograph of a metal-covered liquid crystal polyester multifilament obtained in Example 4, in which stuck fibers and non-stuck fibers are mixed, and which is used for description of stuck fibers.

The X-ray CT cross-sectional photograph of FIG. 4 shows a state in which metal-covered monofilaments shown in FIG. 3 are in close contact with each other. In the state, the monofilaments themselves are not stuck, and thus the monofilaments can be determined to be fibers that are not stuck.

Figure 2:
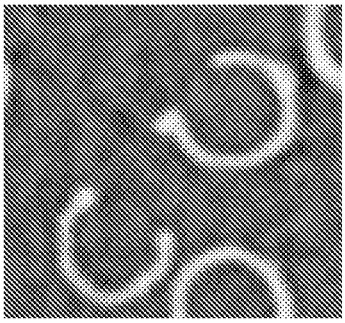
FIG. 2 shows an X-ray CT cross-sectional photograph showing a state in which monofilaments are partially covered with a metal.

The X-ray CT cross-sectional photograph of FIG. 1 shows a state in which a metal is plated on the outer boundary of a bundle of multiple monofilaments that are stuck and the metal is not interposed between monofilaments, and the monofilaments can be determined to be fibers that are stuck.

The X-ray CT cross-sectional photograph of FIG. 2 shows a state in which monofilaments are not partially covered with a metal. This shows a state in which a load is applied to the stuck fibers in which a metal is plated on the outer boundary as shown in FIG. 1 and the stuck fibers are separated (or broken), and the monofilaments can be determined to be fibers that are stuck.

Figure 6:
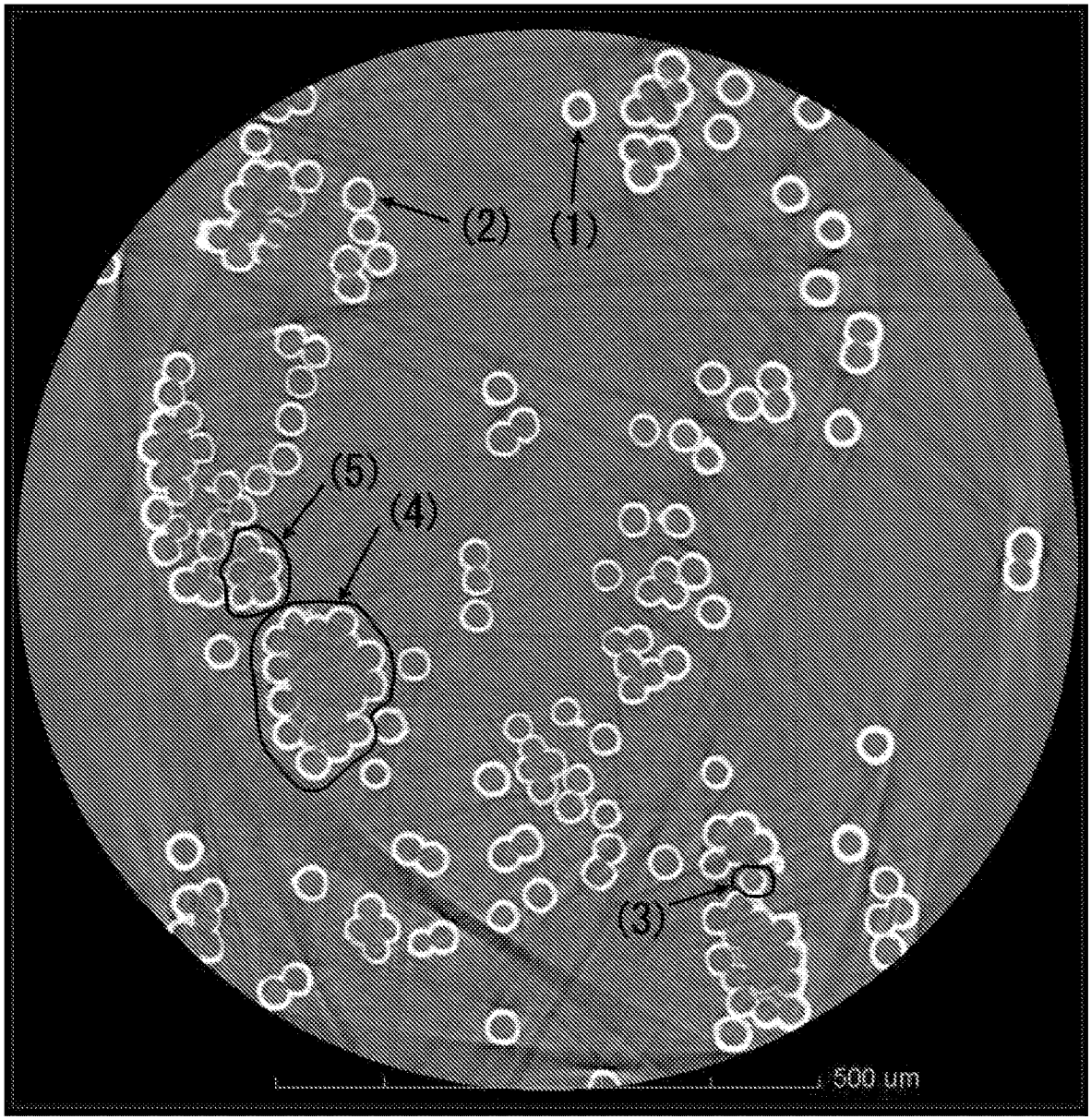
FIG. 6 shows a figure showing an X-ray cross-sectional photograph of the metal-covered liquid crystal polyester multifilament shown in FIG. 5 in which a part of stuck fibers and a part of non-stuck fibers are indicated by numbers.

Stuck fibers will be described more specifically with reference to FIG. 6. FIG. 6 is a figure showing an X-ray cross-sectional photograph of the metal-covered liquid crystal polyester multifilament shown in FIG. 5 in which a part of stuck fibers and a part of non-stuck fiber are indicated by numbers.

The fibers that are not stuck are, for example, those in which the entire circumference (the entire surface) of each monofilament is covered with a metal as shown in (1) of FIG. 6 (those in which the entire substantially circular outer boundary of each monofilament is white without gaps), and those in which a monofilament that is not stuck as shown in (1) is in close contact with another fiber as shown in (2) of FIG. 6 (the former corresponds to the state of FIG. 3, and the latter corresponds to the state of FIG. 4).

The fibers that are stuck (stuck fibers) are fibers other than the fibers that are not stuck, and are, for example, those in which the circumference of the monofilament is partially not covered with a metal (the substantially circular outer boundary of the monofilament is partially not white), as shown in (3) of FIG. 6, and those in which a part not covered with a metal of a metal-covered monofilament (a gap portion in which the substantially circular outer boundary of the monofilament is not white) as shown in (3) of FIG. 6 is at least connected, as shown in (4) and (5) of FIG. 6 (the former corresponds to the state of FIG. 2, and the latter corresponds to the state of FIG. 1).

As described above, in the present specification, a stuck fiber means a fiber in which a circumference (surface portion) of a monofilament is partially not metal-plated in an X-ray cross-sectional photograph, or fibers having a part in which multiple monofilaments are directly connected or in contact without a covering metal interposed therebetween.

In the formula of the sticking percentage, the number of stuck fibers in the X-ray CT cross-sectional photograph means the total number of monofilaments that constitute all stuck fibers. Regarding the number of each group of stuck fibers, for example, the stuck fibers shown in (4) of FIG. 6 are composed of 22 monofilaments, thus the number of the stuck fibers is 22, and the stuck fibers shown in (5) of FIG. 6 are composed of 5 monofilaments, thus the number of the stuck fibers is 5. By counting and adding the numbers of monofilaments that constitute each group of stuck fibers included in the X-ray CT cross-sectional photograph, the number of stuck fibers in the X-ray CT cross-sectional photograph can be calculated. The number of all fibers means the total number of monofilaments including the fibers that are stuck and the fibers that are not stuck in the X-ray CT cross-sectional photograph. The monofilament present at the end of the X-ray CT cross-sectional photograph and having a part partially not shown in the photograph is not included in the number of stuck fibers or the number of all fibers.

In a cross-sectional photograph measured by X-ray CT, a distance between any two farthest points on a surface of a metal covering the stuck fibers is referred to as a sticking distance. The sticking distance indicates the size of the largest width in a group of stuck fibers having the largest width among the groups of stuck fibers in the 10 X-ray CT cross-sectional photographs, and thus the shorter the sticking distance, the smaller the size of the stuck fibers included in the metal-covered liquid crystal polyester multifilament.

Figure 7:
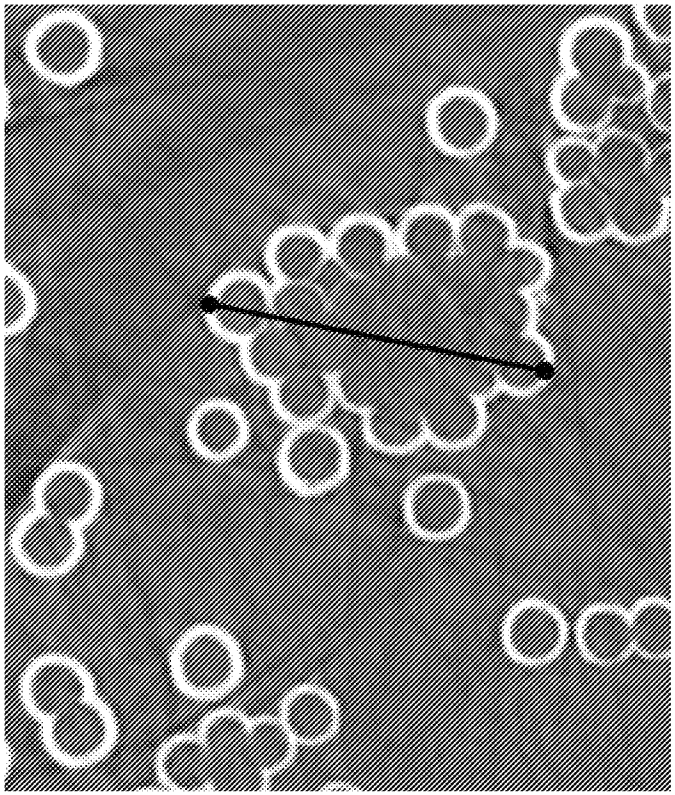
FIG. 7 shows a figure showing a distance between two farthest points on stuck fibers in which the distance between any two points on a surface of the metal covering stuck fibers is the farthest in the X-ray CT cross-sectional photograph of FIG. 5.

More specifically, the sticking distance is determined by selecting a group of stuck fibers in which a distance between any two points on a surface of a metal (white part) covering the stuck fibers is the longest and measuring the distance between the two points. For example, in the X-ray CT cross-sectional photograph of the metal-covered liquid crystal polyester multifilament of FIG. 6, the group of stuck fibers having the farthest distance between any two points on the surface of the metal covering the stuck fibers is the stuck fibers shown in (4), and thus the sticking distance is determined by selecting the stuck fibers shown in (4) and measuring the distance between the two points as shown in FIG. 7.

In an embodiment of the present invention, in the metal-covered liquid crystal polyester multifilament of the present invention, the sticking distance is preferably 11 times or less the diameter of the metal-covered liquid crystal polyester monofilament. Thus, the flexibility and the wearability tend to be improved, and the bending fatigue resistance tends to be increased. The sticking distance is more preferably 9 times or less, still more preferably 7 times or less, and particularly preferably 5 times or less. When the sticking distance is equal to or less than the above upper limit, the flexibility and the wearability tend to be more improved, and the bending fatigue resistance tends to be more increased. The lower limit of the sticking distance is usually 1.2 times or more.

When the diameters of multiple metal-covered liquid crystal polyester monofilaments are different, the sticking distance can be calculated based on the metal-covered liquid crystal polyester monofilament having the largest diameter.

In the present specification, the bending fatigue resistance indicates properties that the change of the resistance value is suppressed even when the metal-covered liquid crystal polyester multifilament is repeatedly bent, and can be evaluated by, for example, a specific resistance value that is a ratio of the resistance value after the bending fatigue test to the resistance value before the bending fatigue test. The specific resistance value can be measured by the following method. The initial resistance value of the metal-covered liquid crystal polyester multifilament is first measured using a resistance value measuring instrument. Subsequently, the specific resistance value can be calculated by bending the metal-covered liquid crystal polyester multifilament under conditions of the bending angle: 120°, the bending speed: 60 rpm, the load: 100 g, the times of bending: 5000 (the times of bending: 100,000 when the specific resistance is close to 1 at 5000 times and comparison is impossible) with plating of a metal such as nickel using a bending fatigue tester, measuring the resistance value again, and substituting the resistance value into the following formula. For example, the resistance value may be calculated by the method described in Examples.

Specific resistance value=(Resistance value after bending fatigue test)/(Initial resistance value before bending fatigue test)

In an embodiment of the present invention, the specific resistance value of the metal-covered liquid crystal polyester multifilament after 5000 times of bending is preferably 25 or less, more preferably 20 or less, even more preferably 15 or less, still more preferably 10 or less, particularly preferably 7 or less, and more particularly preferably 5 or less. When the specific resistance value is equal to or less than the above upper limit, excellent bending fatigue resistance and high conductivity after bending tend to be exhibited. In an embodiment of the present invention, the initial resistance value of the metal-covered liquid crystal polyester multifilament is preferably 0.01 to 10Ω/10 cm, more preferably 0.1 to 5Ω/10 cm, and still more preferably 0.2 to 3Ω/10 cm. When the initial resistance value is within the above range, conductivity tends to be increased.

In the present specification, the wearability refers to ease of putting on a garment including the metal-covered liquid crystal polyester multifilament of the present invention as a smart textile material, and ease of movement or comfort after putting it on. The higher the flexibility (or softness) of the metal-covered liquid crystal polyester multifilament, the more improved the wearability, and thus wearability can be evaluated, for example, by measuring the flexibility (or softness) based on the yarn hardness (also referred to as yarn displacement).

In an embodiment of the present invention, the yarn hardness (yarn displacement) of the metal-covered liquid crystal polyester multifilament is preferably 25 m·dtex·μm or more, more preferably 30 m·dtex·μm or more, even more preferably 35 m·dtex·μm or more, still more preferably 40 m·dtex·μm or more, particularly preferably 50 m·dtex·μm or more, more particularly preferably 60 m·dtex·μm or more, and preferably 100 m·dtex·μm or less. When the yarn hardness is equal to or more than the above lower limit, the flexibility is high and the wearability tends to be increased. When the yarn hardness is equal to or less than the above upper limit, the strength of the fiber tends to be increased. The yarn hardness can be measured by a loop method, and for example, can be measured by the method described in Examples.

The tensile strength of the metal-covered liquid crystal polyester multifilament is preferably 16 cN/dtex or more, more preferably 18 cN/dtex or more, and still more preferably 21 cN/dtex or more. When the tensile strength is equal to or more than the above lower limit, the mechanical strength tends to be increased. The upper limit of the tensile strength of the metal-covered liquid crystal polyester multifilament is preferably 35 cN/dtex or less, and more preferably 30 cN/dtex or less. When the tensile strength is equal to or less than the above upper limit, the flexibility tends to be retained with the bending fatigue resistance and tensile strength being maintained. The tensile strength can be measured using a tabletop precision universal testing machine, and can be measured, for example, by the method described in Examples. Because the tensile strength of the multifilament after plating largely depends on the tensile strength of the multifilament before plating, a numerical value measured using the liquid crystal polyester multifilament before plating may be used as the tensile strength of the metal-covered liquid crystal polyester multifilament.

Though the total fineness of the liquid crystal polyester multifilament in the metal-covered liquid crystal polyester multifilament is not particularly limited, it is preferably 10 dtex or more, more preferably 50 dtex or more, still more preferably 100 dtex or more, and particularly preferably 200 dtex or more, and is preferably 10,000 dtex or less, more preferably 5,000 dtex or less, still more preferably 3,000 dtex or less, and particularly preferably 2,000 dtex or less. The number of metal-covered liquid crystal polyester monofilaments in the metal-covered liquid crystal polyester multifilament is preferably 3 or more, more preferably 5 or more, and preferably 1000 or less, more preferably 500 or less. When the total fineness of the liquid crystal polyester multifilaments and the number of the metal-covered liquid crystal polyester monofilaments in the metal-covered liquid crystal polyester multifilament are within the above ranges, the wearability, the bending fatigue resistance, the lightweight properties, and the strength tend to be increased.

The metal-covered liquid crystal polyester multifilament may be untwisted or lightly twisted, and is preferably lightly twisted from the viewpoint of stabilizing the resistance value. Further, the metal-covered liquid crystal polyester multifilament may be subjected to an opening treatment and/or a smoothing treatment. Fabrics can be thinned, for example, by being produced using such a multifilament subjected to an opening treatment and/or a smoothing treatment.

The form of the metal-covered liquid crystal polyester multifilament is not particularly limited, and may be, for example, a UD (Unidirectional), a nonwoven fabric, a fabric, a knitted fabric, a braid, or a mixed fiber yarn.

<Production Method of Metal-Covered Liquid Crystal Polyester Multifilament>

The production method of the metal-covered liquid crystal polyester multifilament of the present invention is not particularly limited, and for example, methods comprising the following steps are preferred: (i) a spinning step of melt-spinning the liquid crystal polyester; (ii) a solid phase polymerization step of subjecting the spinning raw yarn to solid phase polymerization by heat treatment to obtain a liquid crystal polyester multifilament; and (iii) a plating step of covering the liquid crystal polyester multifilament with a metal.

In the step (i), the liquid crystal polyester can be melt-spun by a conventional method. Usually, spinning is performed at a temperature 10 to 50° C. higher than the melting point of the liquid crystal polyester.

In the step (ii), the spinning raw yarn spun in the step (i) is subjected to a heat treatment to perform solid phase polymerization. The heat treatment during solid phase polymerization improves strength and elastic modulus. In a preferred embodiment of the present invention, by setting the heat treatment temperature to a temperature less than that in the conventional art, sticking of spinning raw yarns can be suppressed, and the sticking percentage and the sticking distance can be reduced, so that the wearability and the bending fatigue resistance can be improved. The heat treatment temperature is preferably 295° C. or less, more preferably 290° C. or less, even more preferably 280° C. or less, still more preferably 270° C. or less, and particularly preferably 260° C. or less. When the heat treatment temperature is equal to or less than the above upper limit, the sticking percentage and the sticking distance tend to be reduced, and the wearability and the bending fatigue resistance tend to be increased. The heat treatment temperature is preferably 200° C. or more, more preferably 220° C. or more, and still more preferably 240° C. or more. When the heat treatment temperature is equal to or more than the above lower limit, solid phase polymerization easily proceeds, and the fiber strength and the elastic modulus tend to be increased. In an embodiment of the present invention, the heat treatment may be performed under a temperature condition in which the temperature is sequentially increased from a temperature equal to or less than the melting point of the liquid crystal polyester fiber within the above heat treatment temperature range.

The heat treatment time can be appropriately selected according to the heat treatment temperature, and is preferably 30 minutes to 30 hours, more preferably 2 to 20 hours, and still more preferably 4 to 18 hours. When the heat treatment time is in the above range, although depending on the heat treatment temperature, solid phase polymerization easily proceeds, so that the sticking percentage and the sticking distance tend to be reduced, and the wearability and the bending fatigue resistance tend to be increased.

Though the method for adjusting the sticking percentage and the sticking distance of the metal-covered liquid crystal polyester multifilament of the present invention to the above ranges of the present invention is not particularly limited, for example, the sticking percentage and the sticking distance can be adjusted to the ranges of the present invention by appropriately adjusting the heat treatment temperature and the heat treatment time in step (ii), the fineness of the polyester monofilament and the like, and preferably adjusting them to the above ranges. For example, as the fineness of the liquid crystal polyester monofilament increases, the sticking percentage and the sticking distance tend to decrease, and as the heat treatment temperature decreases, the sticking percentage and the sticking distance tend to decrease. By optimizing the combination of the heat treatment temperature, the heat treatment time, and the fineness of the polyester monofilament, the sticking percentage and the sticking distance tend to be more reduced. In particular, by optimizing the combination of, in addition to the fineness of the polyester monofilament, the heat treatment temperature and/or the heat treatment time, the sticking percentage and the sticking distance tend to be further reduced. An alkali treatment may be performed as long as the effect of the present invention is not impaired.

The heat treatment in the step (ii) can be performed, for example, in an inert atmosphere such as nitrogen, in an oxygen-containing active atmosphere such as air, or under reduced pressure. The heat treatment is preferably performed in an atmosphere of a gas having a dew point of −40° C. or less.

The step (iii) is a step of covering (plating) the liquid crystal polyester multifilament with a metal. As a method for covering the liquid crystal polyester multifilament with a metal, various methods such as a wet method and a dry method can be employed. Examples of the dry method for covering the liquid crystal polyester multifilament with a metal include extrusion, sputtering, vapor deposition, and conventional methods. The plating step of a wet method for covering the liquid crystal polyester multifilament with a metal can also be performed by conventional methods, and examples thereof include a method in which a plating catalyst is attached to the surface of a liquid crystal polyester monofilament, and then electroless plating is performed, and a method in which electro plating is performed after electroless plating.

The catalyst to be attached may be a metal having a catalytic action for the electroless plating solution. The metal can be appropriately selected according to the kind of the electroless plating solution, and examples thereof include copper, silver, gold, iron, zinc, lead, palladium, nickel, chromium, and tin. These metals can be used singly or in combination of two or more thereof. Examples of the method for applying the catalyst include a method in which a liquid crystal polyester multifilament is immersed in a catalyst solution containing these metals as metal ions, and when copper, nickel or the like is used as the plating metal, a catalyst solution containing palladium ions is preferred, and a catalyst solution containing tin ions and palladium ions is more preferred.

The temperature for immersion in the catalyst solution can be appropriately selected according to the catalyst solution, and is, for example, 20 to 100° C., preferably 25 to 70° C., and the time for immersion in the catalyst solution is, for example, 1 minute to 1 hour, preferably 2 minutes to 30 minutes. The catalyst may be activated by immersing the liquid crystal polyester multifilament to which the catalyst is attached in an acid accelerator (activation treatment liquid) after immersion in a catalyst solution. By subjection to the activation treatment, deposition of metals by the electroless plating treatment can be promoted. A treatment for increasing adhesion between fibers and metals may be performed using a conditioner liquid or a pre-dip liquid.

As the catalyst solution, commercially available products can be used, and examples of the commercially available products include "Sulcup" series manufactured by Uyemura & Co., Ltd. [for example, "Sulcup AT-105" (colloidal tin-palladium catalyst) manufactured by Uyemura & Co., Ltd., Ltd.], and "OPC-80 Catalyst" manufactured by OKUNO CHEMICAL INDUSTRIES CO., LTD. (colloidal tin-palladium catalyst).

As a method for the electroless plating treatment, a conventional method can be used, and examples thereof include a method in which a liquid crystal polyester multifilament to which a catalyst is attached is immersed in an electroless plating solution. Examples of the metal to be electroless plated include the metals described in the section of <Metal>.

The electroless plating solution may contain, for example, a metal salt as a main component and other additives (for example, a reducing agent, a complexing agent, and a leveler). The temperature of the electroless plating solution can be appropriately selected according to the kind of the electroless plating solution, and is, for example, 20 to 130° C., preferably 30 to 100° C., and the time of the electroless plating treatment is, for example, 10 minutes to 20 hours, preferably 15 minutes to 10 hours.

As the electroless plating solution, commercially available products can be used, and examples of the commercially available products include, for example, electroless copper plating solutions "ATS-ADDCOPPER IW-A", "ATS-ADDCOPPER IW-M", and "ATS-ADDCOPPER IW-C", an electroless gold plating solution "Self-Gold OTK-IT", an electroless silver plating solution "Dain Silver EL-3S", and an electroless nickel-phosphorus plating solution "TOP NICOLON BL 80" manufactured by OKUNO CHEMICAL INDUSTRIES CO., LTD.; and electroless nickel plating solutions "Nimuden KTB-3-M" and "Nimuden KTB-3-A" manufactured by Uyemura & Co., Ltd. After electroless plating, for example, electrolytic plating can also be performed.

The application of the metal-covered polyester multifilament of the present invention is not particularly limited, and the metal-covered polyester multifilament can be widely used in the smart textile field, the electromagnetic wave shielding field and the like, which are fields where conductive fibers are used. In particular, the metal-covered polyester multifilament of the present invention can achieve both the wearability and the bending fatigue resistance, and thus is useful as a smart textile material, for example, an electrode, a wiring or the like of a smart textile.

EXAMPLES

Hereinafter, the present invention will be specifically described with reference to Examples, but these do not limit the scope of the present invention. Measurement and evaluation methods will be described below.

<Tensile Strength>

The tensile strength (cN/dtex) of the metal-covered liquid crystal polyester multifilament obtained in each of Examples and Comparative Examples was measured under the following conditions. At this time, because the strength of the plated fiber largely depends on the fiber strength of the polyallylate before plating, the tensile strength was calculated based on the original fiber fineness.

(Conditions)

Test instrument: Autograph AGS-100 B (manufactured by SHIMADZU CORPORATION)

Test conditions: JIS L 1013

Yarn length: 200 mm

Initial load: 0.09 cN/dtex

Tensile speed: 100 mm/min

<Resistance Value Measurement and Bending Fatigue Test>

The initial resistance value (Ω/10 cm) of the metal-covered liquid crystal polyester multifilament obtained in each of Examples and Comparative Examples was measured using a resistance value measuring instrument (manufactured by TEXIO TECHNOLOGY CORPORATION). Subsequently, the metal-covered liquid crystal polyester multifilament was bent under conditions of the bending angle: 120°, the bending speed: 60 rpm, the load: 100 g, the times of bending: 5000 using a bending fatigue tester (manufactured by Yuasa), and the resistance value was measured again. The specific resistance value was calculated by the following formula, and the bending fatigue resistance was evaluated.

Specific resistance value=(Resistance value after bending fatigue test)/(Initial resistance value before bending fatigue test)

In Examples 6 and 7, the measurement was also performed under the condition of the times of bending of 100,000.

<Cross-Sectional Observation by X-Ray CT>

[Calculation of Sticking Percentage]

10 cross-sectional photographs of the metal-covered liquid crystal polyester multifilament obtained in each of Examples and Comparative Examples were taken at intervals of 50 μm by X-ray CT, and the number of stuck fibers that are stuck and the number of all fibers in the cross-sectional photographs were counted in 10 cross-sectional photographs according to the following criteria. Then, the ratio (sticking percentage) of the number of stuck fibers to the total number of fibers was determined by the following formula.

Sticking percentage (%)=(Number of stuck fibers)/(Number of all fibers)×100

The discrimination between stuck fibers and fibers that are not stuck and the determination of the number of stuck fibers were made according to the criteria described in paragraphs [0036] to [0042].

[Calculation of Sticking Distance]

In the cross-sectional photographs of the metal-covered liquid crystal polyester multifilament obtained in each of Examples and Comparative Examples taken as described above, the stuck fibers in which the distance between any two points on the surface of the metal covering the stuck fibers was the farthest were selected, and the distance between the two points was measured. This distance was divided by the diameter of the metal-covered liquid crystal polyester monofilament to determine the distance (sticking distance) between any two farthest points on the surface of the metal covering the stuck fibers with respect to the diameter of the metal-covered liquid crystal polyester monofilament.

<Yarn Hardness>

Figure 10:
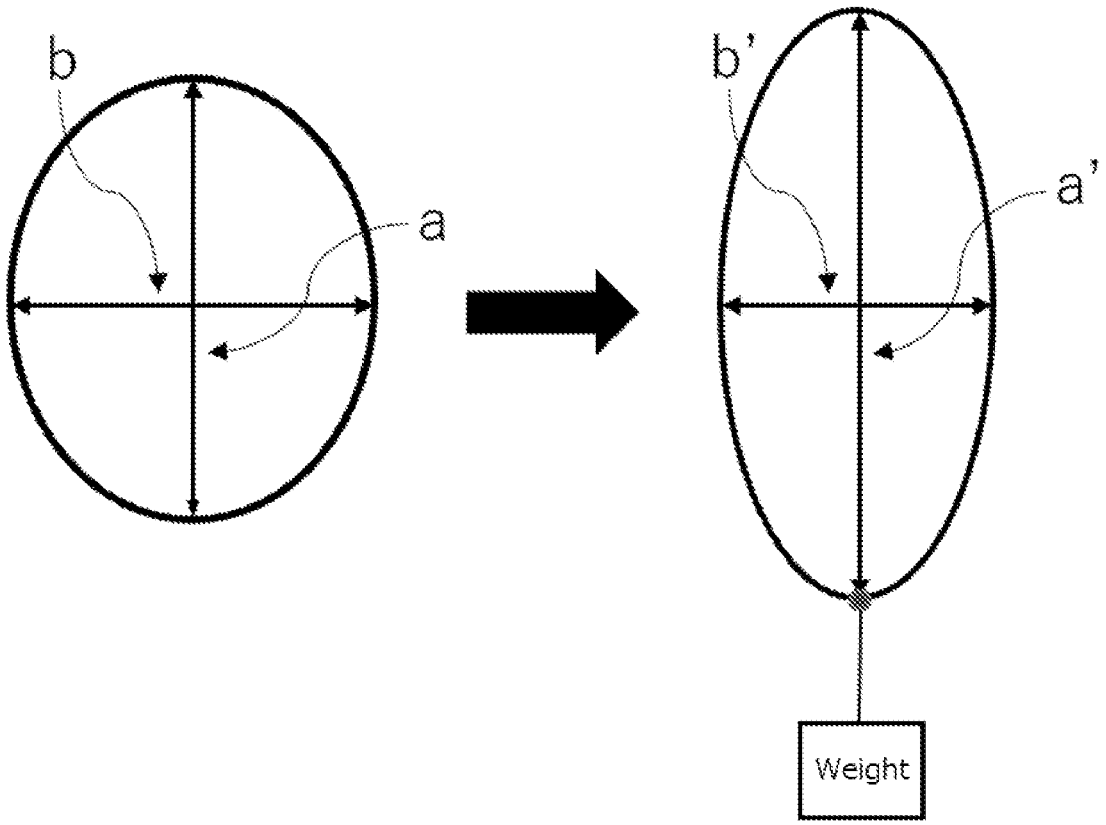
FIG. 10 shows a figure showing lengths a and a' in the longitudinal direction and lengths b and b' in the lateral direction for determining the yarn hardness.

The yarn hardness of the metal-covered liquid crystal polyester multifilament obtained in each of Examples and Comparative Examples was measured by a loop method. Specifically, the metal-covered liquid crystal polyester monofilament was taken out from the metal-covered liquid crystal polyester multifilament, a ring having a diameter of about 30 mm was formed, and the length a (mm) in the longitudinal direction and the length b (mm) in the lateral direction were measured as shown in FIG. 10. Thereafter, a weight of 1 g was hooked on the lower part of the ring, and the length a' (mm) in the longitudinal direction and the length b' (mm) in the lateral direction were measured. Finally, the total of the longitudinal length displacement and the lateral length displacement was determined by the following equation, and taken as the yarn hardness (or yarn displacement).

$$\text{Yarn hardness (mm)}=(a'-a)+(b-b')$$

When this method is used, the smaller the fineness, the greater the yarn hardness (yarn displacement), and the smaller the thickness of the plated metal, the greater the yarn hardness (yarn displacement) even if the sticking percentage is the same. Thus, the yarn hardness cannot be simply compared. Thus, for correction, a numerical value obtained by multiplying the yarn hardness, the fineness and the plating thickness was calculated as the yarn hardness (correction value) (m·dtex·μm).

$$\text{Yarn hardness (correction value) (m·dtex·μm)}=\text{Yarn hardness (m)}\times\text{Fineness (dtex)}\times\text{Plating thickness (μm)}$$

The greater the yarn hardness, the softer the fiber and the higher the flexibility (or softness). Thus, the metal-covered liquid crystal polyester multifilament having a greater yarn hardness is excellent in wearability of clothing when used as a smart textile material.

<Thickness>

The thickness of the metal covering the metal-covered liquid crystal polyester multifilament obtained in each of Examples and Comparative Examples was measured from the X-ray CT images described above.

Example 1

(Solid Phase Polymerization)

As a spinning raw yarn, a liquid crystal polyester multifilament (manufactured by KURARAY CO., LTD., trade name: VECTRAN HT spinning raw yarn) having a total fineness of 1670 dtex and 300 filaments was used. The above fiber was gradually heated in a range of room temperature to 250° C. under a nitrogen atmosphere, and subjected to a heat treatment for 16 hours to be solid phase polymerized.

(Application of Catalyst)

To wash the surface of the solid phase polymerized multifilament, 5 ml of Sulcup MTE-1-A (manufactured by Uyemura & Co., Ltd.) was added to 95 ml of ion-exchanged water, the multifilament cut to 1 m was further added, and the mixture was stirred at 50° C. for 5 minutes. Then, to assist catalyst adsorption to the fiber surface, 27 g of Sulcup PED-104 (manufactured by Uyemura & Co., Ltd.) was added to 95 ml of ion-exchanged water, the washed multifilament was added, and the mixture was stirred at 30° C. for 2 minutes. Subsequently, for adsorption of the catalyst, 27 g of Sulcup PED-104 (manufactured by Uyemura & Co., Ltd.) and 3 ml of Sulcup AT-105 (manufactured by Uyemura & Co., Ltd.) were added, the volume was made up to 100 ml with ion-exchanged water, and then the multifilament subjected to the adsorption assist was added and washed at 30° C. for 8 minutes. Finally, to activate the catalyst, 10 ml of Sulcup AL-106 (manufactured by Uyemura & Co., Ltd.) was added to 90 ml of ion-exchanged water, then the multifilament subjected to the catalyst adsorption was added, and the mixture was stirred at 25° C. for 3 minutes. Thereby, a liquid crystal polyester multifilament in which a catalyst was attached to the surface was obtained.

(Electroless Cu Plating)

Figure 8:
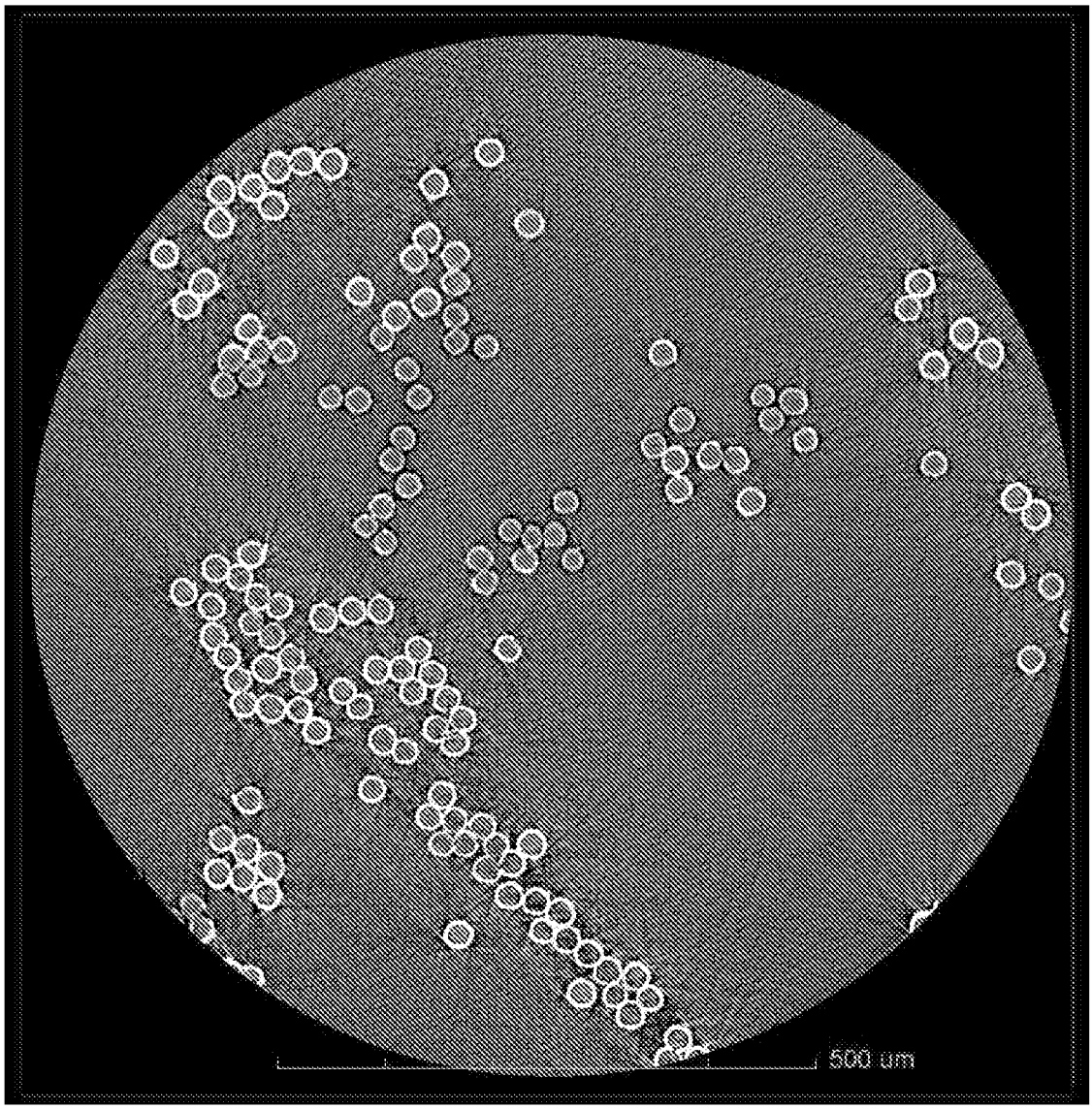
FIG. 8 shows an X-ray CT cross-sectional photograph of a metal-covered liquid crystal polyester multifilament obtained in Example 1, showing a state in which sticking of fibers is small and a metal is interposed between fibers.

ATS-ADDCOPPER IW-A (30 ml) (manufactured by OKUNO CHEMICAL INDUSTRIES CO., LTD.), ATS-ADDCOPPER IW-M (48 ml) (manufactured by OKUNO CHEMICAL INDUSTRIES CO., LTD.), ATS ADDCOPPER IW-C (6 ml), and ion-exchanged water (516 ml) were added, the multifilament to which the catalyst was applied was charged, and then the mixture was stirred in a hot water bath at 42° C. for 30 minutes. Thereby, a metal-covered liquid crystal polyester multifilament comprising metal-covered liquid crystal polyester monofilaments in which the surface of each liquid crystal polyester monofilament is covered with copper was obtained. An X-ray CT cross-sectional photograph of the obtained metal-covered liquid crystal polyester multifilament is shown in FIG. 8.

Example 2

A metal-covered liquid crystal polyester multifilament covered with copper was obtained in the same manner as in Example 1 except that the heat treatment condition was gradual rising of temperature in the range of room temperature to 270° C.

Example 3

A metal-covered liquid crystal polyester multifilament covered with copper was obtained in the same manner as in Example 1 except that the heat treatment condition was gradual rising of temperature in the range of room temperature to 290° C.

Example 4

A metal-covered liquid crystal polyester multifilament covered with copper was obtained in the same manner as in Example 1 except that a liquid crystal polyester multifilament (manufactured by KURARAY CO., LTD., trade name: VECTRAN HT spinning raw yarn) having a total fineness of 440 dtex and 80 filaments was used as a spinning raw yarn, and the heat treatment condition was gradual rising of temperature in the range of room temperature to 275° C.

Example 5

A metal-covered liquid crystal polyester multifilament covered with copper was obtained in the same manner as in Example 4 except that the heat treatment condition was gradual rising of temperature in the range of room temperature to 290° C.

Example 6

A metal-covered liquid crystal polyester multifilament covered with nickel was obtained in the same manner as in Example 3 except that the plating solution was changed to a nickel plating solution. An X-ray CT cross-sectional photograph of the obtained metal-covered liquid crystal polyester multifilament is shown in FIG. 5.

(Electroless Ni Plating)

Nimuden KTB-3-M (90 ml) (manufactured by Uyemura & Co., Ltd.), Nimuden KTB-3-A (33 ml) (manufactured by Uyemura & Co., Ltd.), and ion-exchanged water (480 ml) were added, the liquid crystal polyester multifilament to which a catalyst was applied was charged, and then the mixture was stirred in a hot water bath at 85° C. for 25 minutes.

Example 7

A metal-covered liquid crystal polyester multifilament covered with nickel was obtained in the same manner as in Example 6 except that a liquid crystal polyester multifilament (manufactured by KURARAY CO., LTD., trade name: VECTRAN HT spinning raw yarn) having a total fineness of 1670 dtex and 50 filaments was used as a spinning raw yarn.

Example 8

A metal-covered liquid crystal polyester multifilament covered with copper was obtained in the same manner as in Example 1 except that a liquid crystal polyester multifilament (manufactured by KURARAY CO., LTD., trade name: VECTRAN UM spinning raw yarn) having a total fineness of 1580 dtex and 200 filaments was used as a spinning raw yarn.

Example 9

A metal-covered liquid crystal polyester multifilament covered with copper was obtained in the same manner as in Example 1 except that a liquid crystal polyester multifilament (manufactured by KURARAY CO., LTD., trade name: VECTRAN HT spinning raw yarn) having a total fineness of 560 dtex and 20 filaments was used as a spinning raw yarn.

Comparative Example 1

A metal-covered liquid crystal polyester multifilament covered with copper was obtained in the same manner as in Example 1 except that the heat treatment condition of the spinning raw yarn was gradual rising of temperature in the range of room temperature to 300° C.

Comparative Example 2

A metal-covered liquid crystal polyester multifilament covered with copper was obtained in the same manner as in Example 1 except that the heat treatment condition of the spinning raw yarn was gradual rising of temperature in the range of room temperature to 310° C.

Comparative Example 3

Figure 9:
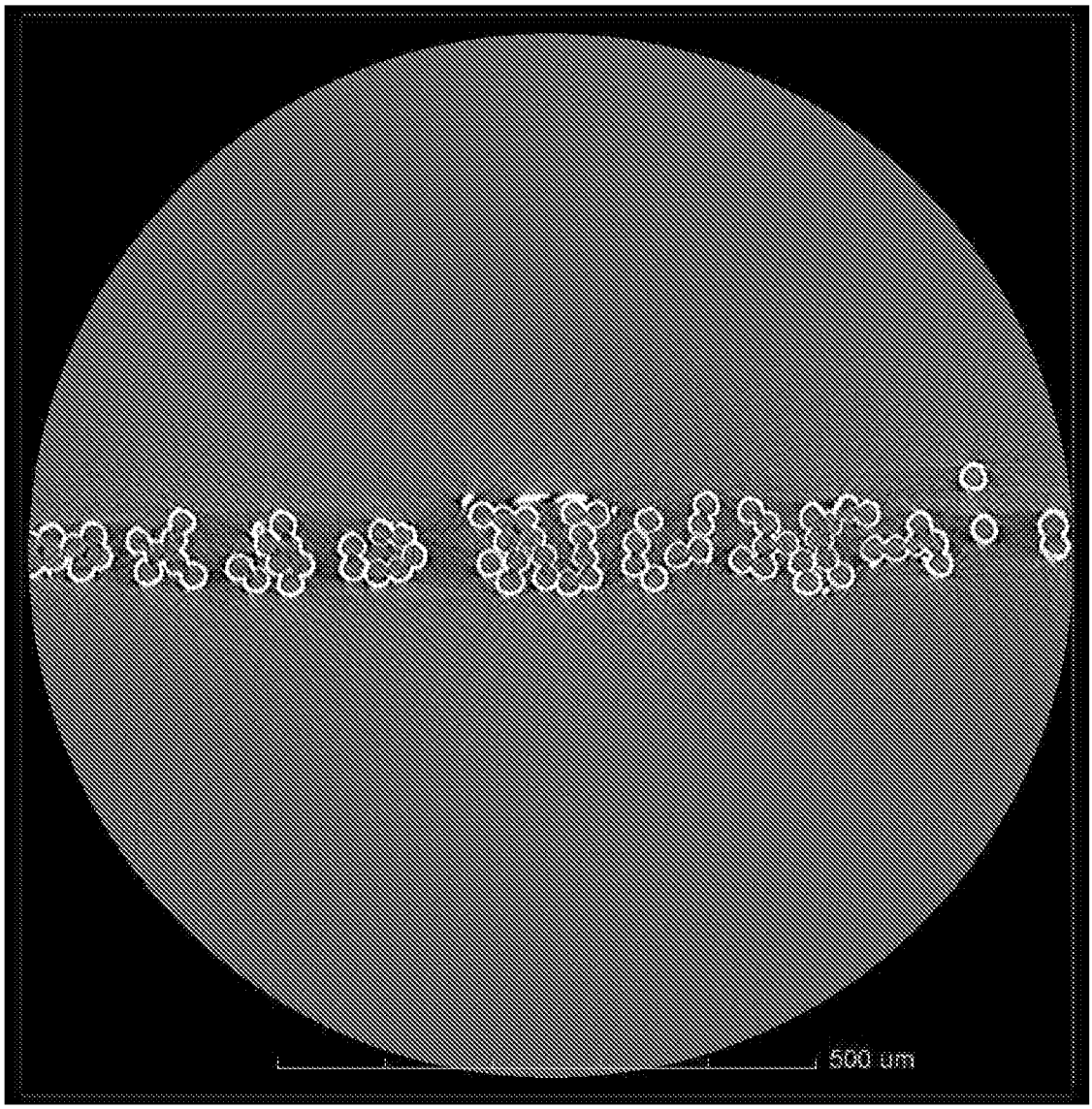
FIG. 9 shows an X-ray CT cross-sectional photograph of a metal-covered liquid crystal polyester multifilament obtained in Comparative Example 3, showing a state in which sticking of fibers is large and a metal is not interposed between fibers.

A metal-covered liquid crystal polyester multifilament covered with copper was obtained in the same manner as in Example 4 except that the heat treatment condition of the spinning raw yarn was gradual rising of temperature in the range of room temperature to 310° C. An X-ray CT cross-sectional photograph of the obtained metal-covered liquid crystal polyester multifilament is shown in FIG. 9.

The results of measuring the sticking percentage, the sticking distance, the tensile strength, the yarn hardness (yarn displacement), the yarn hardness (correction value), the initial resistance value, and the specific resistance value of the metal-covered liquid crystal polyester multifilaments obtained in Examples 1 to 9 and Comparative Examples 1 to 3 according to the above measurement method are shown in Table 1. The total fineness, the number of filaments (the number of monofilaments), the heat treatment temperature, the fineness of the liquid crystal polyester monofilament (single fiber), the plated metal, and the thicknesses of the plated metal are also shown in Table 5.

TABLE 5

| | Total fineness dtex | Number of filaments Number | Fineness of single fiber dtex | Heat treatment temperature ° C. | Plated metal | Thickness of metal μm | Tensile strength cN/dtex | Sticking percentage % | Sticking distance — | Yarn hardness (displacement) mm | Yarn hardness (correction value) m · dtex · μm | Initial resistance value Ω/10 cm | Specific resistance After 5,000 times of bending — | Specific resistance After 100,000 times of bending — |
|---|---|---|---|---|---|---|---|---|---|---|---|---|---|---|
| Example 1 | 1670 | 300 | 5.6 | 250 | Copper | 3.2 | 23.9 | 10 | 2 | 12.5 | 66.8 | 1.42 | 5.03 | — |
| Example 2 | 1670 | 300 | 5.6 | 270 | Copper | 3.3 | 24.2 | 31 | 4.1 | 10.2 | 56.2 | 1.71 | 10.9 | — |
| Example 3 | 1670 | 300 | 5.6 | 290 | Copper | 3.3 | 26.6 | 60 | 7.9 | 9.0 | 49.6 | 1.96 | 22.5 | — |
| Comparative Example 1 | 1670 | 300 | 5.6 | 300 | Copper | 3.4 | 25.8 | 78 | 11.5 | 7.5 | 42.6 | 2.17 | 53.0 | — |
| Comparative Example 2 | 1670 | 300 | 5.6 | 310 | Copper | 4.0 | 21.1 | 98 | 20 | 3.0 | 20.0 | 0.78 | 2.30 | — |
| Example 4 | 440 | 80 | 5.6 | 275 | Copper | 3.4 | 23.9 | 43 | 2.8 | 28.4 | 42.5 | 1.36 | 2.51 | — |
| Example 5 | 440 | 80 | 5.6 | 290 | Copper | 3.2 | 27.9 | 60 | 3.4 | 26.1 | 36.7 | 1.57 | 3.80 | — |
| Comparative Example 3 | 440 | 80 | 5.6 | 310 | Copper | 3.1 | 22.0 | 88 | 3.8 | 16 | 21.8 | 3.38 | 1.79 | — |
| Example 6 | 1670 | 300 | 5.6 | 290 | Nickel | 6.0 | 28.5 | 64 | 8 | 4.5 | 45.1 | 1.82 | 1.25 | 28.4 |
| Example 7 | 1670 | 50 | 33 | 290 | Nickel | 9.0 | 26.2 | 13 | 2 | 4.5 | 67.6 | 2.15 | 1.26 | 4.47 |
| Example 8 | 1580 | 200 | 7.9 | 250 | Copper | 3.2 | 16.9 | 8.4 | 2 | 15.5 | 78.4 | 2.3 | 9.57 | — |
| Example 9 | 560 | 20 | 28 | 250 | Copper | 3.2 | 22.1 | 6.3 | 2 | 28.2 | 50.5 | 2.8 | 1.20 | — |

As shown in Table 5, the metal-covered liquid crystal polyester multifilaments of Comparative Examples 2 and 3 have low yarn hardnesses and thus have low fiber flexibility. The metal-covered liquid crystal polyester multifilament of Comparative Example 1 has a large specific resistance value and thus has low bending fatigue resistance. Thus, it was found that the metal-covered liquid crystal polyester multifilaments obtained in Comparative Examples 1 to 3 are not suitable for smart textile material applications.

On the other hand, the metal-covered liquid crystal polyester multifilaments of Examples 1 to 9 have larger yarn hardnesses as compared with Comparative Examples 2 and 3 and thus have excellent fiber flexibility, and have smaller specific resistance values as compared with Comparative Example 1 and thus have excellent bending fatigue resistance. Thus, the metal-covered liquid crystal polyester multifilament of the present invention was found to be excellent in wearability of clothing and bending fatigue resistance even when it is used as a smart textile material.

Comparison of Examples 6 and 7 shows that the specific resistance value after 100,000 times of bending is extremely excellent in Example 7 in which the single fiber has a larger fineness (thick fiber), and it was also found that higher bending resistance can be obtained by using a polyallylate fiber having a large fineness.

The invention claimed is:

1. A metal-covered liquid crystal polyester multifilament, comprising:

two or more metal-covered liquid crystal polyester monofilaments;

wherein:

a surface of each monofilament is covered with a metal to a thickness of 0.1 to 20 μm;

a sticking percentage of the multifilament is 75% or less; and the sticking percentage is a percentage of a number of stuck fibers relative to a total number of fibers in a cross-sectional photograph of the multifilament obtained by X-ray CT.

2. The metal-covered liquid crystal polyester multifilament according to claim 1, wherein, in a cross-sectional photograph of the multifilament obtained by X-ray CT, a distance between any two farthest points on a surface of a metal covering stuck fibers is 11 times or less a diameter of a single metal-covered monofilament.

3. The metal-covered liquid crystal polyester multifilament according to claim 1, having a tensile strength of 16 cN/dtex or more.

4. The metal-covered liquid crystal polyester multifilament according to claim 1, wherein the metal comprises at least one selected from the group consisting of copper, silver, gold, iron, zinc, lead, palladium, nickel, chromium, tin, titanium, aluminum, indium, and vanadium.

5. The metal-covered liquid crystal polyester multifilament according to claim 1, wherein a fineness of each of the liquid crystal polyester monofilaments is 11 dtex or more.

6. The metal-covered liquid crystal polyester multifilament according to claim 1, wherein;

a specific resistance value of the multifilament is 25 or less; and the specific resistance value is a ratio of a resistance value of the multifilament after a bending fatigue test to a resistance value of the multifilament before a bending fatigue test.

7. The metal-covered liquid crystal polyester multifilament according to claim 2, having a tensile strength of 16 cN/dtex or more.

8. The metal-covered liquid crystal polyester multifilament according to claim 2, wherein the metal comprises at least one selected from the group consisting of copper, silver, gold, iron, zinc, lead, palladium, nickel, chromium, tin, titanium, aluminum, indium, and vanadium.

9. The metal-covered liquid crystal polyester multifilament according to claim 2, wherein a fineness of each of the liquid crystal polyester monofilaments is 11 dtex or more.

10. The metal-covered liquid crystal polyester multifilament according to claim 2, wherein:

a specific resistance value of the multifilament is 25 or less; and the specific resistance value is a ratio of a resistance value of the multifilament after a bending fatigue test to a resistance value of the multifilament before a bending fatigue test.

11. The metal-covered liquid crystal polyester multifilament according to claim 3, wherein the metal comprises at least one selected from the group consisting of copper, silver, gold, iron, zinc, lead, palladium, nickel, chromium, tin, titanium, aluminum, indium, and vanadium.

12. The metal-covered liquid crystal polyester multifilament according to claim 3, wherein a fineness of each of the liquid crystal polyester monofilaments is 11 dtex or more.

13. The metal-covered liquid crystal polyester multifilament according to claim 3, wherein:

a specific resistance value of the multifilament is 25 or less; and the specific resistance value is a ratio of a resistance value of the multifilament after a bending fatigue test to a resistance value of the multifilament before a bending fatigue test.

14. The metal-covered liquid crystal polyester multifilament according to claim 4, wherein a fineness of each of the liquid crystal polyester monofilaments is 11 dtex or more.

15. The metal-covered liquid crystal polyester multifilament according to claim 4, wherein:

a specific resistance value of the multifilament is 25 or less; and the specific resistance value is a ratio of a resistance value of the multifilament after a bending fatigue test to a resistance value of the multifilament before a bending fatigue test.

16. The metal-covered liquid crystal polyester multifilament according to claim 5, wherein:

a specific resistance value of the multifilament is 25 or less; and the specific resistance value is a ratio of a resistance value of the multifilament after a bending fatigue test to a resistance value of the multifilament before a bending fatigue test.

* * * * *